US008187112B2

(12) United States Patent
Guittar

(10) Patent No.: US 8,187,112 B2
(45) Date of Patent: May 29, 2012

(54) KIT FOR PROVIDING TRAINING FOR POOL GAME BANK SHOTS AND METHOD THEREOF

(76) Inventor: Steven Guittar, Richmond, VA (US)

( * ) Notice: Subject to any disclaimer, the term of this patent is extended or adjusted under 35 U.S.C. 154(b) by 0 days.

(21) Appl. No.: 12/512,338

(22) Filed: Jul. 30, 2009

(65) Prior Publication Data

US 2010/0056286 A1 Mar. 4, 2010

Related U.S. Application Data

(60) Provisional application No. 61/092,815, filed on Aug. 29, 2008.

(51) Int. Cl.
*A63D 15/00* (2006.01)

(52) U.S. Cl. ..... 473/2

(58) Field of Classification Search ..... 473/1–4, 473/17, 108, 78; D21/316, 782, 789, 783, D21/309; 273/352
See application file for complete search history.

(56) References Cited

U.S. PATENT DOCUMENTS

| | | | | | |
|---|---|---|---|---|---|
| 735,132 | A | * | 8/1903 | McCutche, Jr. | 273/119 R |
| 797,317 | A | * | 8/1905 | Peter | 473/108 |
| 803,520 | A | * | 10/1905 | Arney | 273/123 R |
| 2,000,123 | A | * | 5/1935 | Cahill | 473/5 |
| 2,537,228 | A | * | 1/1951 | Matson | 473/2 |
| 2,708,577 | A | * | 5/1955 | Bunka | 473/2 |
| 3,138,387 | A | * | 6/1964 | Michel et al. | 473/159 |
| 3,704,889 | A | * | 12/1972 | Huffman et al. | 273/119 R |
| D228,079 | S | * | 8/1973 | Huffman | D21/309 |
| 4,027,883 | A | * | 6/1977 | Batori | 473/2 |
| 4,114,876 | A | * | 9/1978 | Maruszak | 273/108.21 |
| 4,854,589 | A | * | 8/1989 | Davis | 273/123 R |
| 4,875,680 | A | * | 10/1989 | Gross | 273/108.21 |
| D335,515 | S | * | 5/1993 | Caron | D21/783 |
| 5,520,581 | A | * | 5/1996 | Mazzoli | 473/2 |
| 5,765,828 | A | * | 6/1998 | Baker et al. | 273/108.2 |
| 5,919,095 | A | | 7/1999 | Risner | |
| 6,942,576 | B2 | * | 9/2005 | Holt | 473/2 |
| 7,118,486 | B2 | * | 10/2006 | Evers | 473/2 |
| 7,744,477 | B2 | * | 6/2010 | Cook | 473/2 |

* cited by examiner

*Primary Examiner* — Mitra Aryanpour
(74) *Attorney, Agent, or Firm* — Aidenbaum Schloff and Bloom PLLC; Jay Schloff

(57) ABSTRACT

A kit and a method for providing training for pool game bank shots. The kit comprises a plurality of aiming posts and a plurality of base members. Each aiming post of the plurality of aiming posts comprises a proximal end portion and a distal end portion. Each base member of the plurality of base members comprises a hollow central portion for receiving the proximal end portion of an aiming post. The proximal end portion of the aiming post received in the hollow central portion of a base member enables the aiming post to assume an upright position. The aiming post of the plurality of aiming posts configured in the upright position and positioned at a pre-determined distance from a pool table provides an aiming point for aiming at least one of a cue ball and an object ball for executing a pool game bank shot.

8 Claims, 6 Drawing Sheets

KIT FOR PROVIDING TRAINING FOR POOL GAME BANK SHOTS AND METHOD THEREOF

CROSS REFERENCE TO RELATED APPLICATIONS

The present disclosure claims priority under 35 United States Code, Section 119 on the U.S. Provisional Patent Application No. 61/092,815 filed on Aug. 29, 2008, the disclosure of which is incorporated by reference.

FIELD OF THE DISCLOSURE

The present disclosure generally relates to training aids for a pool game, and, more particularly to a kit and a method for providing training for pool game bank shots.

BACKGROUND OF THE DISCLOSURE

A pool game typically includes a pool table aligned with pockets. The game is generally played with a cue stick, which is used to strike an object ball with a cue ball in a manner to direct the object ball towards the pocket of the pool table. While playing the pool game, it may be required to execute a shot whereby the object ball is bounced against a rail or a cushion configured on edges of the pool table to direct the object ball in one of the pockets opposite to the rail or the cushion of the pool table. Such a shot is commonly known as a pool game bank shot (hereinafter referred to as a bank shot). Further, while playing the pool game, it may also be required to execute a shot whereby the cue ball is first bounced against the rail or the cushion of the pool table. Such a shot is commonly known as pool game kick shot. For amateur players of the game, these bank shots or kick shots are extremely difficult to play as compared to regular shots whereby the cue ball and the object ball are aligned with the pocket of the pool table. Playing the regular shots requires aligning and shooting of the object ball with the cue ball directly to a target such as the pocket of the pool table, whereas, playing the bank shot requires setting an exact angle along the intermediate target such as the rail or cushion of the pool table from which the object ball is to be directed to a final target, such as the pocket of the pool table.

Various teaching methods have been recommended for helping the amateur players with bank shots. In one such approach towards playing the bank shots accurately, dots (also known as diamonds), configured on the rail of the pool table are used. The diamonds on the rail of the pool table act as an aiming point for shooting the object ball or the cue ball, which may assist in executing a bank shot. However, the diamonds may mislead the amateur players and create confusion while playing the bank shots and, as such, may not be useful by themselves for amateur players.

Another method for helping the amateur players with bank shots is a mirror-based bank shot teaching method. In the mirror-based method, a mirror is fixedly positioned near the rail or the cushion at a specific angle to create a virtual image of a pool table extending from the actual pool table, thereby enabling an amateur player to virtually line up the bank shot while standing in a natural shooting position. However, such a method has proved to be unreliable and difficult for amateur players to adopt for accurately playing the bank shots.

Accordingly, there exists a need for providing training for pool game bank shots, especially for amateur players of the pool game. Further, there exists a need for enabling a player of a pool game to effectively execute a pool game bank shot without seeking professional assistance or instruction.

SUMMARY OF THE DISCLOSURE

In view of the foregoing disadvantages inherent in the prior art, the general purpose of the present disclosure is to provide a kit and a method for providing training for pool game bank shots to include all the advantages of the prior art, and to overcome the drawbacks inherent therein.

Accordingly, an object of the present disclosure is to provide training for pool game bank shots, especially for amateur players of a pool game.

Another object of the present disclosure is to enable a player of a pool game to effectively execute a pool game bank shot without seeking professional help.

In light of the above objects, in one aspect of the present disclosure, a kit for providing training for pool game bank shots is disclosed. The kit comprises a plurality of aiming posts and a plurality of base members. Each aiming post of the plurality of aiming posts comprises a proximal end portion and a distal end portion. Each base member of the plurality of base members comprises a hollow central portion for receiving the proximal end portion of an aiming post of the plurality of aiming posts. The proximal end portion of the aiming post received in the hollow central portion of a base member of the plurality of base members enables the aiming post to assume an upright position. The aiming post of the plurality of aiming posts configured in the upright position and positioned at a pre-determined distance from a pool table provides an aiming point for aiming at least one of a cue ball and an object ball for executing a pool game bank shot.

In another aspect, the present disclosure provides a method for providing training for pool game bank shots. The method comprises configuring an upright position of at least one aiming post of a plurality of aiming posts by receiving a proximal end portion of the at least one aiming post in a hollow central portion of a base member of a plurality of base members. The at least one aiming post configured in the upright position is positioned at a predetermined distance from a pool table and at least one of a cue ball and an object ball is shot towards the upright aiming post. The at least one aiming post configured in the upright position at the predetermined distance from the pool table provides an aiming point for aiming the at least one of the cue ball and the object ball for executing a pool game bank shot.

The kit may be used by players of the pool game, and especially by amateur players, for training for pool game bank shots. Practicing the pool game bank shot using an aiming post of the plurality of aiming posts configured in an upright position enables the players to effectively execute the pool game bank shots. Moreover, the kit is designed to be easily self-configured, thereby enabling the players of the pool game to effectively execute the pool game bank shot without seeking professional help.

This together with other aspects of the present disclosure, along with the various features of novelty that characterize the present disclosure, is pointed out with particularity in the claims annexed hereto and form a part of this present disclosure. For a better understanding of the present disclosure, its operating advantages, and the specific objects attained by its uses, reference should be made to the accompanying drawing and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawing, in which:

Like reference numerals refer to like parts throughout the description of several views of the drawings.

DETAILED DESCRIPTION OF THE DISCLOSURE

The exemplary embodiments described herein detail for illustrative purposes are subject to many variations in composition, structure, and design. It should be emphasized, however, that the present disclosure is not limited to a kit and a method for providing training for pool game bank shots as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "a" and "an" herein do not denote a limitation of quantity, but rather denote the presence of at least one of the referenced item.

The present disclosure provides a kit and a method for providing training for pool game bank shots. Players, especially amateur players, of the pool game may utilize the kit for practicing the pool game bank shots and thereby effectively execute the pool game bank shots. Moreover, the players can assemble the kit themselves and practice the pool game bank shots thereby learning to execute bank shots without seeking professional assistance or instruction.

Figure 1:
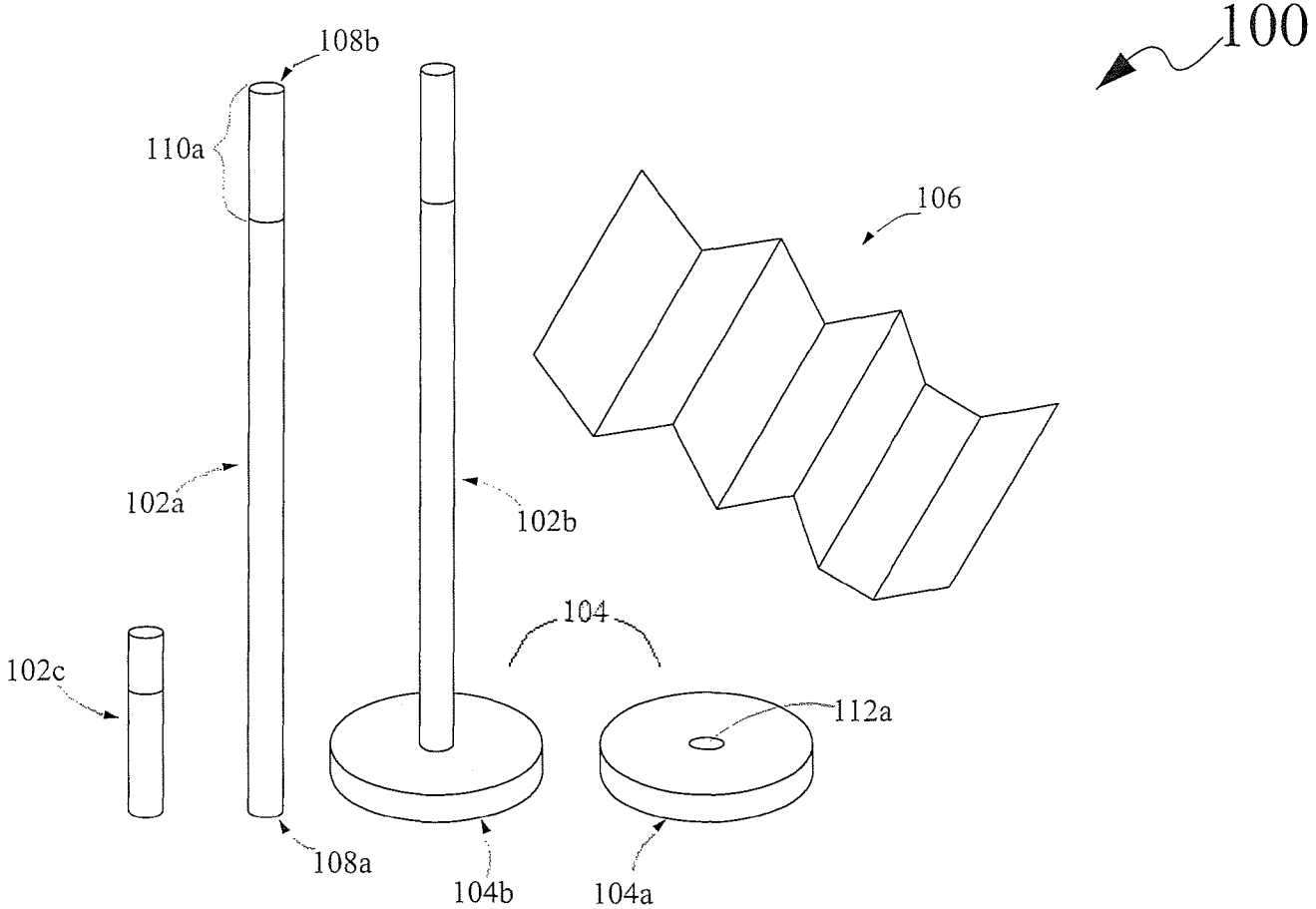
FIG. 1 illustrates a perspective view of a kit for providing training for pool game bank shots, in accordance with an embodiment of the present disclosure.

Referring now to FIG. 1, a perspective view of a kit 100 for providing training for pool game bank shots is illustrated in accordance with an embodiment of the present disclosure. The kit 100 includes a plurality of aiming posts, such as an aiming post 102*a*, an aiming post, 102*b* and an aiming post 102*c*, a plurality of base members, such as a base member 104*a* and a base member 104*b*, and an instruction manual 106. The plurality of aiming posts, such as the aiming posts 102*a*, 102*b* and 102*c* will hereinafter be collectively referred to as plurality of aiming posts 102 (not shown). The plurality of base members, such as the base member 104*a* and the base member 104*b* will hereinafter be collectively referred to as plurality of base members 104 (not shown).

Each of the plurality of aiming posts 102 includes a proximal end portion and a distal end portion opposite to the proximal end portion. For example, the aiming post 102*a* includes a proximal end portion 108*a* and a distal end portion 108*b* opposite to the proximal end portion 108*a*. It will be obvious to a person skilled in the art that the aiming posts 102*b* and 102*c* include the proximal end portion and the distal end portion, such as those of the aiming post 102*a*, and are not shown in FIG. 1 for sake of brevity of the description. Further, each of the plurality of aiming posts 102 may be constructed of colored material or may be constructed of unpainted wood. Such colored aiming posts 102 may enable a player of a pool game to clearly distinguish the each aiming post from its respective background and thereby better aim a cue ball or an object ball for execution of the pool game bank shots.

Further, FIG. 1 depicts each base member of the plurality of base members 104 to configure a hollow central portion in a disc-shaped body member. For example, the base member 104*a* includes a hollow central portion 112*a*. It will be evident to a person skilled in the art that the base member 104*b* includes a similar hollow central portion (not shown). The hollow central portion of each of the plurality of base members 104 are configured to receive the proximal end portion of an aiming post of the plurality of aiming posts 102, thereby configuring an upright position of the aiming post. In FIG. 1, a proximal end portion of the aiming post 102*b* is received in the hollow central portion of the base member 104*b*, thereby configuring an upright position of the aiming post 102*b*. It will be obvious to a person skilled in the art that the proximal end portion of each of the aiming posts 102*a* and 102*c* may also be similarly received in the hollow central portion of a base member of the plurality of base members 104 for configuring the upright position of the aiming posts 102*a* and 102*c*.

An aiming post of the plurality of aiming posts 102 configured in the upright position, such as the aiming post 102*b*, may be positioned at a pre-determined distance from a pool table (not shown) for executing a pool game bank shot (hereinafter referred to as a bank shot). The aiming post configured in the upright position provides an aiming point for aiming at least one of a cue ball and an object ball for executing the bank shot. The determination of the pre-determined distance is based on size of the pool table, pre-selected points on a short axis of the pool table, pre-selected points on a long axis of the pool table and an axial line passing through at least a pair of pocket centers and/or diamonds of the pool table.

In an embodiment of the present disclosure, at least one aiming post of the plurality of aiming posts 102 is about 31 inches in a length dimension. In another embodiment of the present disclosure, at least one aiming post of the plurality of aiming posts 102 is about 5 inches in the length dimension. In FIG. 1, the aiming posts 102*a* and 102*b* are depicted to be about 31 inches in length dimension and the aiming post 102*c* is depicted to be about 5 inches in length dimension. The aiming posts 102*a* and 102*b* configured to be about 31 inches in the length dimension may enable the player of the pool game to configure the aiming posts 102*a* and 102*b* in the upright position and dispose the aiming posts 102*a* and 102*b* on a floor along side of the pool table as a floor target such that the aiming posts 102*a* and 102*b* are visible while standing in natural shooting position. The aiming post 102*c* configured to be about 5 inches in the length dimension may be positioned as a table top target for aiming the at least one of the cue ball and the object ball for execution of the bank shot. It will be evident to a person skilled in the art that the length dimension for the plurality of aiming posts 102 are disclosed for exemplary purposes and as such may not be considered as limiting.

It will be obvious to a person skilled in the art that the kit 100 may include aiming posts of any such dimension for providing a suitable aiming point for executing the bank shot.

The instruction manual 106 includes instructions for executing the bank shot. In an embodiment of the present disclosure, the instruction manual 106 may be a pocket-size pamphlet with 6 pages of information printed on both sides of the pamphlet. In an embodiment of the present disclosure, the instruction manual 106 may include information, such as information for positioning the aiming post configured in the upright position at various positions along side the pool table, calibration method for positioning the aiming post in case of pool table irregularities, practice tips for effective execution of the bank shot and the like. The amateur players may use the instruction manual to select the axis such as short axis or long axis and use tables of pre-measured distances provided in the instruction manual for positioning the aiming post for the various table sizes for effective execution of the bank shot.

Positioning of the aiming post configured in the upright position is explained in conjunction with FIGS. 2A, 2B, 3A and 3B.

Figure 2A:
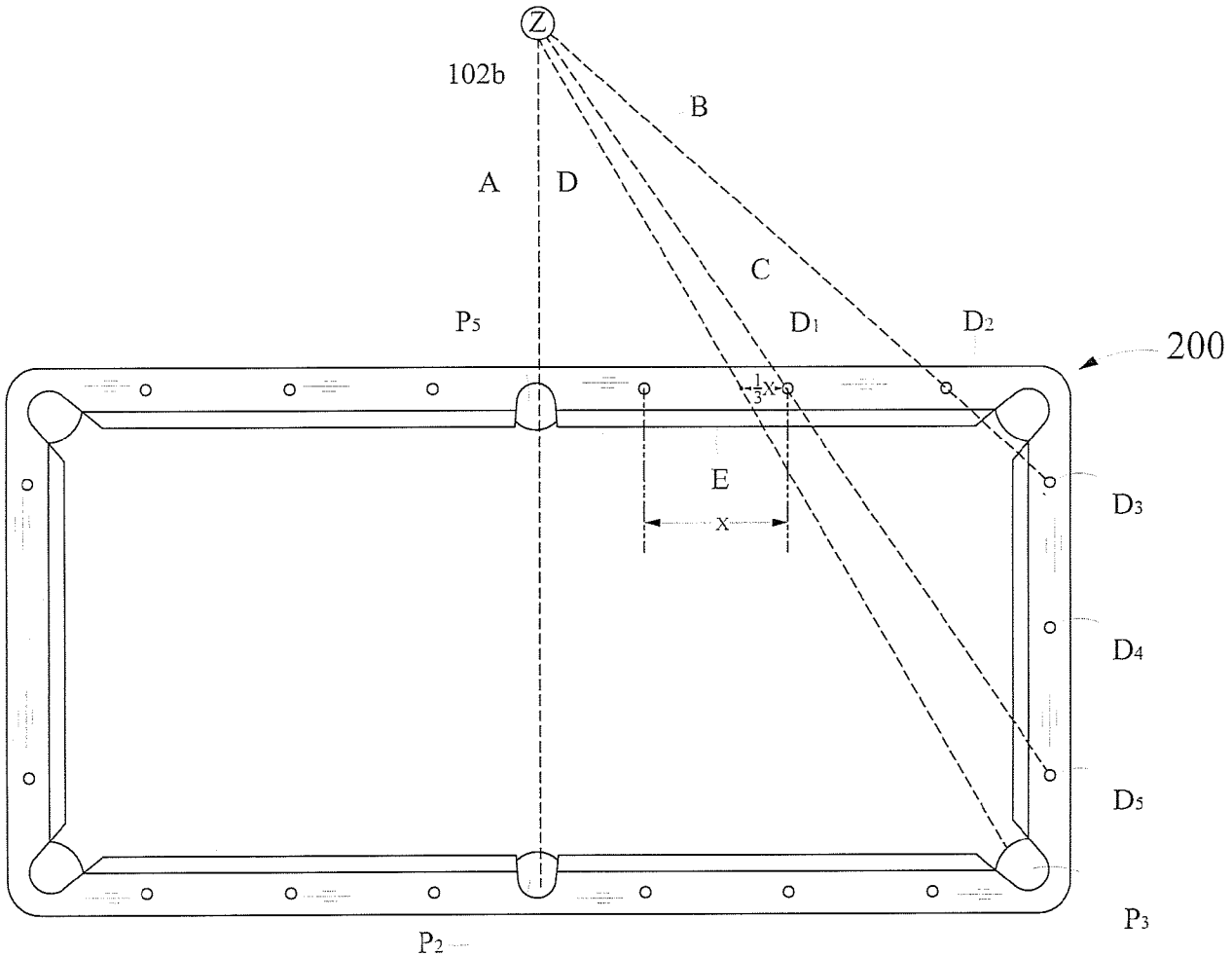
FIG. 2A illustrates a top view of a pool table for determining positioning of an aiming post configured in an upright position for executing a short axis pool game bank shot, in accordance with an exemplary embodiment of the present disclosure.

FIG. 2A illustrates a top view of a pool table 200 for determining positioning of an aiming post configured in an upright position, such as the aiming post 102*b*, of FIG. 1, for executing a short axis pool game bank shot, in accordance with an exemplary embodiment of the present disclosure. A width dimension (shorter dimension) of the pool table 200 may be referred to as a short axis of the pool table 200 and a bank shot played along the short axis may be referred to as a short axis pool game bank shot (hereinafter referred to as short axis bank shot). The pool table 200 includes pockets, such as pocket $P_2$, pocket $P_3$ and pocket $P_5$, and diamond markings, such as diamond marking $D_1$, diamond marking $D_2$, diamond marking $D_3$, diamond marking $D_4$ and diamond marking $D_5$.

As explained in conjunction with FIG. 1, the aiming post configured in the upright position may be positioned at a pre-determined distance from the pool table, such as the pool table 200, for providing an aiming point for aiming the at least one of the cue ball and the object ball for executing a bank shot, such as the short axis bank shot. Such a position of the aiming post at the pre-determined distance from the pool table may be referred to as a Z position. Moreover, as explained in FIG. 1, the pre-determined distance from the pool table 200, and, more specifically a location of the Z position, may be determined based on size of the pool table 200, pre-selected points on the short axis of the pool table 200, pre-selected points on a long axis of the pool table 200 and an axial line passing through at least a pair of pocket centers of the pool table 200.

In FIG. 2A, the pool table 200 for playing pool game bank shots is depicted. For the pool table 200, the pre-selected points on the short axis of the pool table 200 may be the diamond marking $D_3$ and the diamond marking $D_5$, and, the pre-selected points on the long axis of the pool table 200 may be the diamond marking $D_1$ and the diamond marking $D_2$. A cross-over point of an imaginary dotted axial line A passing through pocket centers $P_2$ and $P_5$, an imaginary dotted line B passing through the diamond marking $D_2$ and the diamond marking $D_3$, and an imaginary dotted line C passing through the diamond marking $D_1$ and the diamond marking $D_5$, may be chosen as the Z position for positioning the aiming post configured in the upright position. Alternatively, a cross-over point of the imaginary dotted axial line A and an imaginary dotted line D passing through pocket centers of the pocket $P_3$ and a point 'E' on a rail bearing the diamond marking $D_1$ and the diamond marking $D_2$ located at about ⅓ distance (shown as ⅓x in FIG. 2A) of total distance 'x' between two diamond markings from diamond marking $D_1$ may be chosen as the Z position for positioning the aiming post configured in the upright position.

The Z position determined, as described herein, may be utilized by the player of the pool game for disposing the aiming post configured in the upright position. The player may then visually align a center of the at least one of the cue ball and the object ball with an central axis of the aiming post and shoot the at least one of the cue ball and the object ball for executing the short axis bank shot. An exemplary execution of two short axis bank shots based on positioning the aiming post configured in the upright position at the Z position as described in conjunction with FIG. 2A is depicted in FIG. 2B.

Figure 2B:
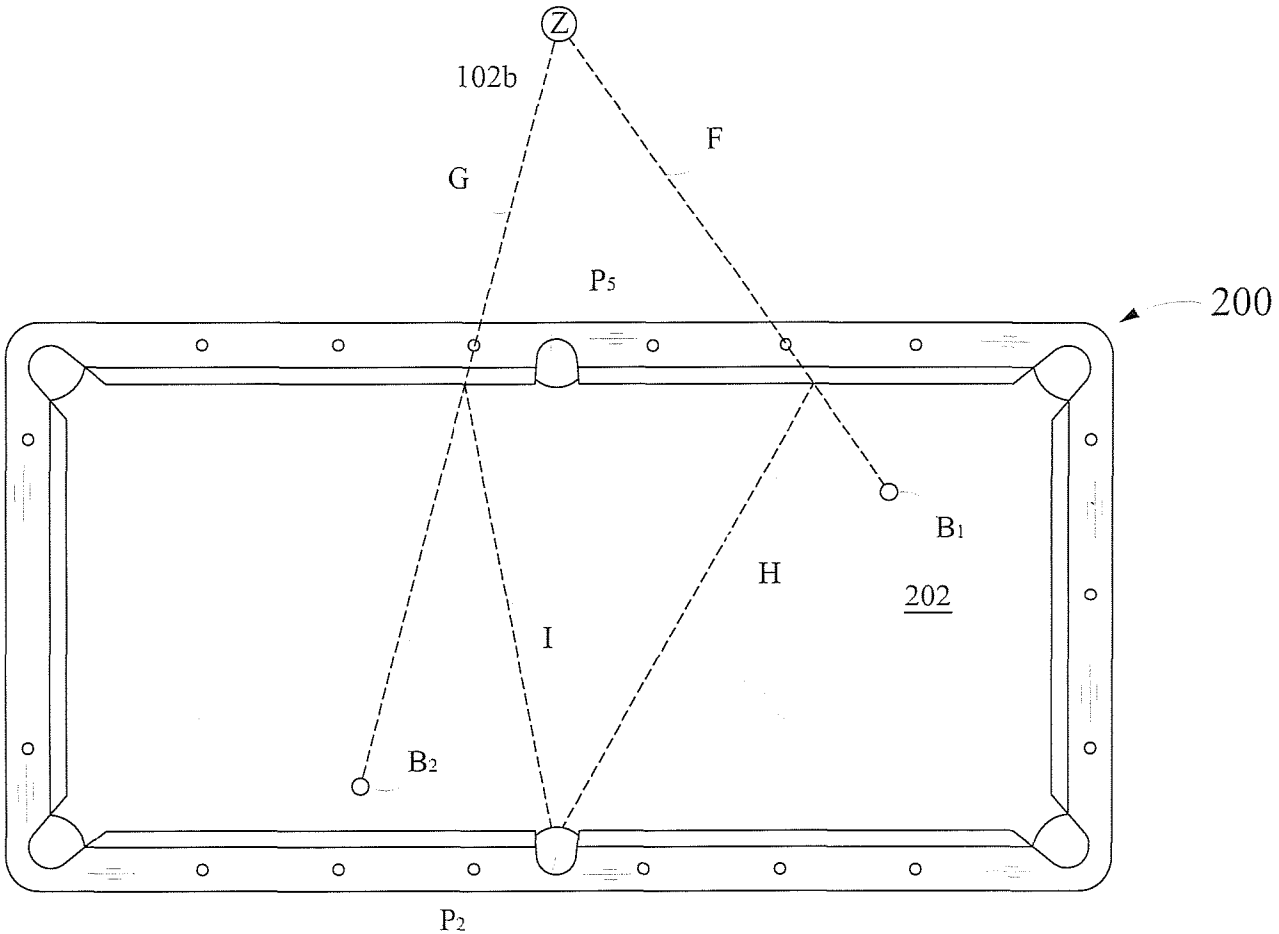
FIG. 2B illustrates a top view of the pool table for depicting an exemplary execution of the short axis pool game bank shot of FIG. 2A.

FIG. 2B illustrates a top view of the pool table 200 for depicting an exemplary execution of the two short axis bank shots of FIG. 2A. As explained in conjunction with FIG. 2A, the aiming post configured in the upright position may be positioned at a pre-determined distance from the pool table 200, such as the Z position, for providing an aiming point for aiming the at least one of the cue ball and the object ball for executing the short axis bank shots. In FIG. 2B, the aiming post is depicted to be disposed at the Z position, a location of which may be determined as explained in conjunction with FIG. 2A. Two pool balls, such as pool ball $B_1$ and pool ball $B_2$ are disposed on a playing surface 202 of the pool table 200. It will be evident to a person skilled in the art that a player of the pool game may utilize any one of the cue ball and the object ball or both as the pool ball $B_1$ and pool ball $B_2$ for training the execution of the short axis bank shots. For executing the short axis bank shots, each of the pool balls $B_1$ and $B_2$ may need to be directed towards a rail of the pool table 200 bearing the pocket $P_5$ for depositing the pool balls $B_1$ and $B_2$ in the pocket $P_2$.

Accordingly, the player may utilize the aiming post disposed at the Z position for aiming each of pool balls $B_1$ and $B_2$ (trajectory depicted by imaginary dotted line F and imaginary dotted line G, respectively) and may then direct the pool balls $B_1$ and $B_2$, using a cue stick and cue ball, towards the rail for depositing the pool balls $B_1$ and $B_2$ in the pocket $P_2$ (trajectory depicted by imaginary dotted lines H and imaginary dotted line I), thereby executing the short axis pool game bank shot. It will be evident to a person skilled in the art that the positioning of the pool balls $B_1$ and $B_2$ are depicted for exemplary purposes and the pool balls $B_1$ and $B_2$ may be positioned at any position on the playing surface 202 of the pool table 200. The player may practice directing a pool ball disposed at any position on the playing surface 202 towards the aiming post disposed at the Z position for training for executing the short axis bank shots. A long axis pool game bank shot may be executed in a manner similar to the execution of the short axis pool game bank shot as explained in conjunction with FIGS. 3A and 3B.

Figure 3A:
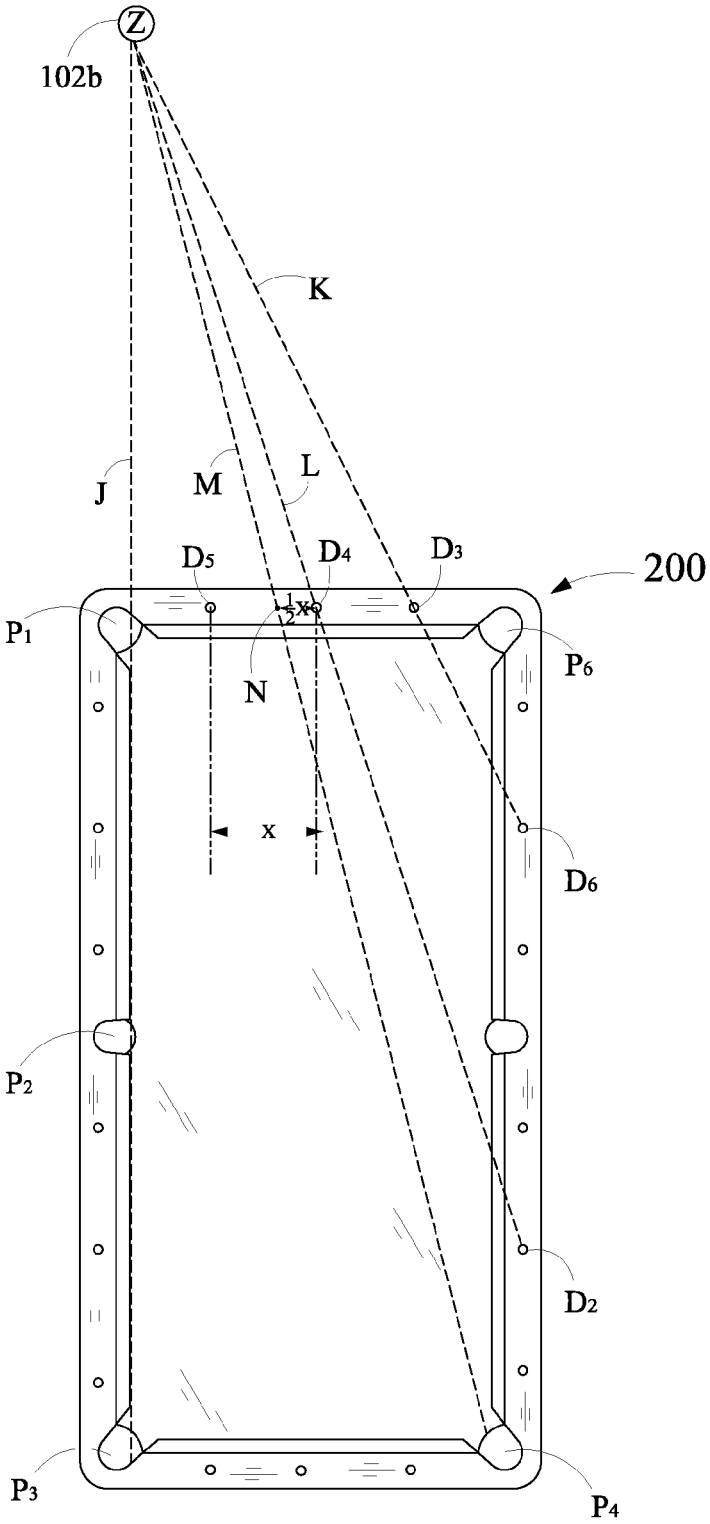
FIG. 3A illustrates a top view of the pool table for determining positioning of an aiming post configured in an upright position for executing a long axis pool game bank shot, in accordance with an exemplary embodiment of the present disclosure.

FIG. 3A illustrates a top view of the pool table 200 for determining positioning of an aiming post configured in an upright position, such as the aiming post 102*b* of FIG. 1, for executing a long axis pool game bank shot, in accordance with an exemplary embodiment of the present disclosure. A length dimension (longer dimension) of the pool table 200 may be referred to as a long axis of the pool table 200 and a bank shot played along the long axis may be referred to as a long axis pool game bank shot (hereinafter referred to as long axis bank shot). The pool table 200 includes pockets, such as pocket $P_1$, pocket $P_2$, pocket $P_3$ and pocket $P_4$, and diamond markings, such as diamond marking $D_2$, diamond marking $D_6$, diamond marking $D_3$, diamond marking $D_4$ and diamond marking $D_5$.

As explained in conjunction with FIG. 1, the aiming post configured in the upright position may be positioned at a pre-determined distance from the pool table, such as the pool table 200, for providing an aiming point for aiming the at least one of the cue ball and the object ball for executing a bank shot, such as the long axis bank shot. Such a position of the aiming post at the pre-determined distance from the pool table 200 may be referred to as a Z position. Moreover, as explained in FIG. 1, the pre-determined distance from the pool table 200, and, more specifically a location of the Z position, may be determined based on size of the pool table 200, pre-selected points on the short axis of the pool table 200, pre-selected points on a long axis of the pool table 200 and an axial line passing through at least a pair of pocket centers of the pool table 200.

In FIG. 3A, the pool table 200 for playing pool game bank shots is depicted. For the pool table 200, the pre-selected points on the short axis of the pool table 200 may be the diamond marking $D_3$ and the diamond marking $D_4$, and, the pre-selected points on the long axis of the pool table 200 may be the diamond marking $D_2$ and the diamond marking $D_6$. A cross-over point of an imaginary dotted axial line J passing through pocket centers $P_1$, $P_2$ and $P_3$, an imaginary dotted line K passing through the diamond marking $D_6$ and the diamond marking $D_3$, and an imaginary dotted line L passing through the diamond marking $D_2$ and the diamond marking $D_4$, may be chosen as the Z position for positioning the aiming post configured in the upright position. Alternatively, a cross-over point of the imaginary dotted axial line J and an imaginary dotted line M passing through pocket center of pocket $P_4$ and a point 'N' on a rail bearing the diamond marking $D_3$ and the diamond marking $D_4$ at about ½ distance (shown as ½x in FIG. 3A) of total distance 'x' between two diamond markings from diamond marking $D_4$ may be chosen as the Z position for positioning the aiming post configured in the upright position.

The Z position determined, as described herein, may be utilized by the player of the pool game for disposing the aiming post configured in the upright position. The player may then visually align a center of the at least one of the cue ball and the object ball with an central axis of the aiming post and shoot the at least one of the cue ball and object ball for executing the long axis bank shot. An exemplary execution of the long axis bank shot based on positioning the aiming post configured in the upright position at the Z position as described in conjunction with FIG. 3A is depicted in FIG. 3B.

Figure 3B:
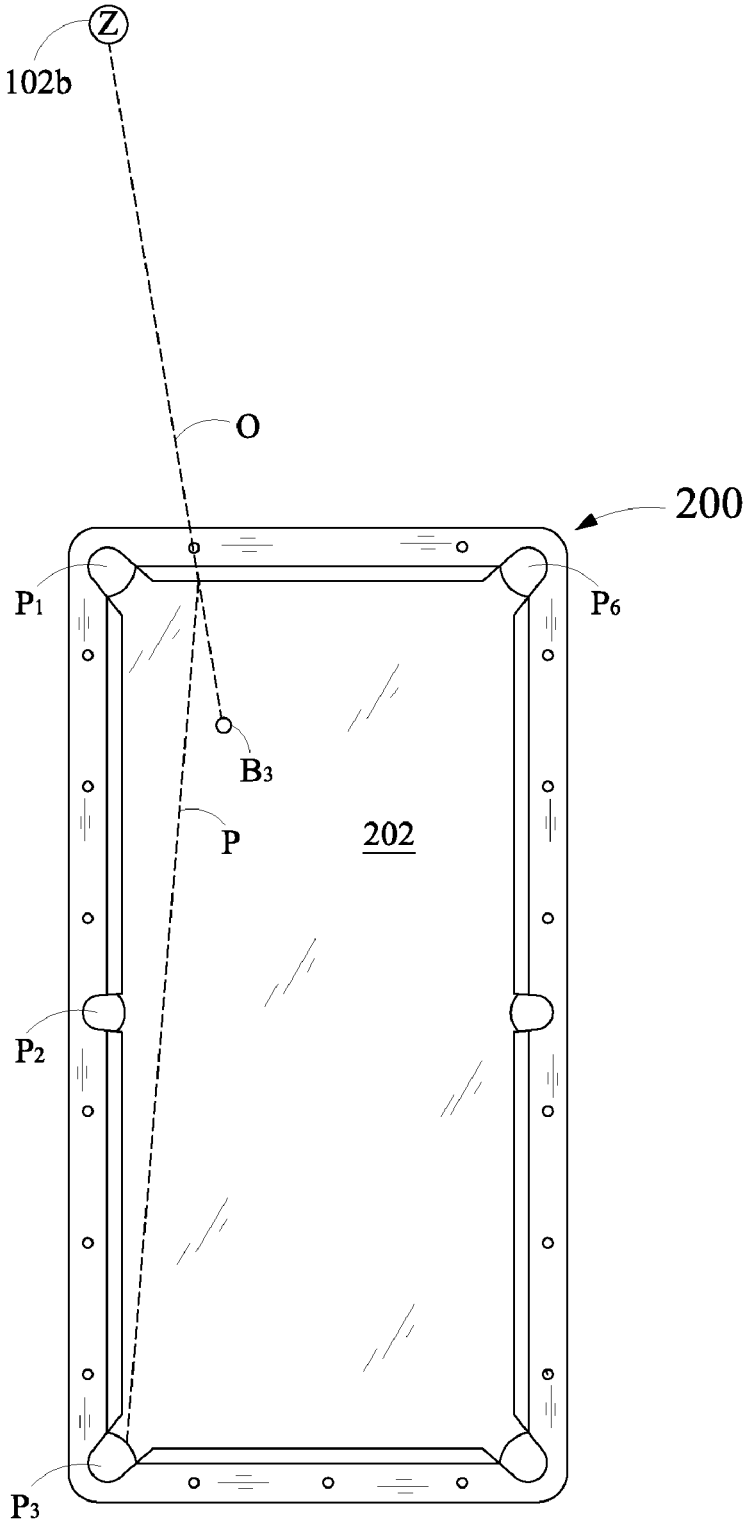
FIG. 3B illustrates a top view of the pool table for depicting an exemplary execution of the long axis pool game bank shot of FIG. 3A.

FIG. 3B illustrates a top view of the pool table 200 for depicting an exemplary execution of the long axis bank shot of FIG. 3A. As explained in conjunction with FIG. 3A, the aiming post configured in the upright position may be positioned at a pre-determined distance from the pool table 200, such as the Z position, for providing an aiming point for aiming the at least one of the cue ball and the object ball for executing the long axis bank shot. In FIG. 3B, the aiming post is depicted to be disposed at the Z position, a location of which may be determined as explained in conjunction with FIG. 3A. A pool ball, such as pool ball $B_3$ is disposed on the playing surface 202 of the pool table 200. It will be evident to a person skilled in the art that a player of the pool game may utilize any one of the cue ball and the object ball as the pool ball $B_3$ for training for executing the long axis bank shot. For executing the long axis bank shot the pool ball $B_3$ may need to be directed towards a rail of the pool table 200 bearing the pocket $P_1$ pocket $P_6$ for depositing the pool ball $B_3$ in the pocket $P_3$.

Accordingly, the player may utilize the aiming post disposed at the Z position for aiming the pool ball $B_3$ (trajectory depicted by imaginary dotted line O) and may then direct the pool balls $B_3$ using a cue ball and cue stick towards the rail for depositing the pool ball $B_3$ in the pocket $P_3$ (trajectory depicted by imaginary dotted line P), thereby executing the long axis bank shot. It will be evident to a person skilled in the art that the positioning of the pool ball $B_3$ is depicted for exemplary purposes and the pool ball $B_3$ may be positioned at any position on the playing surface 202 of the pool table 200. The player may practice directing a pool ball disposed at any position on the playing surface 202 towards the aiming post disposed at the Z position for training for executing the long axis bank shots.

In FIGS. 2A, 2B, 3A and 3B, a pool table 200 is depicted to be a leveled and squarely emplaced pool table and the determination of the Z position for executing the short axis bank shot and the long axis bank shot is based on such leveling and squarely emplacement of the pool table. If not properly leveled and emplaced, the pool table may need to be recalibrated.

The recalibration process includes positioning the aiming post configured in the upright position at the Z position as described in FIG. 2A or FIG. 3A. Further, a proximal end portion of two cue sticks are secured using a rubber band and disposed at a slightly elevated position above a rail of the pool table. Furthermore, a pool ball is directed towards the Z position using the two cue sticks with slightly elevated proximal end portions to determine and verify a return point of the pool ball back from an opposite rail to the rail bearing the slightly elevated proximal end portions of the two cue sticks. Pool balls are then rolled towards the opposite rail for directing the pool balls in a pre-designated pocket and the return point of the pool balls are recorded. The proximal end portion of the two cue sticks are adjusted till the return point coincides with the return point for the pool balls directed towards the rail and deposited in the pre-designated pocket. The recalibration process further includes shooting a pool ball towards the opposite rail with the two cue sticks in adjusted position until the pool ball is directed towards the pre-designated pocket. The two cue sticks are held in the adjusted position and the aiming post configured in the upright position is then moved along an imaginary axial line passing through the pocket centers towards a point of crossing of the imaginary axial line and an imaginary line passing through the two cue sticks in the adjusted position to determine the exact Z position for the aiming post configured in the upright position for executing a bank shot, such as the short axis bank shot and the long axis bank shot. A method for providing training for the bank shots is explained in conjunction with FIG. 4.

Figure 4:
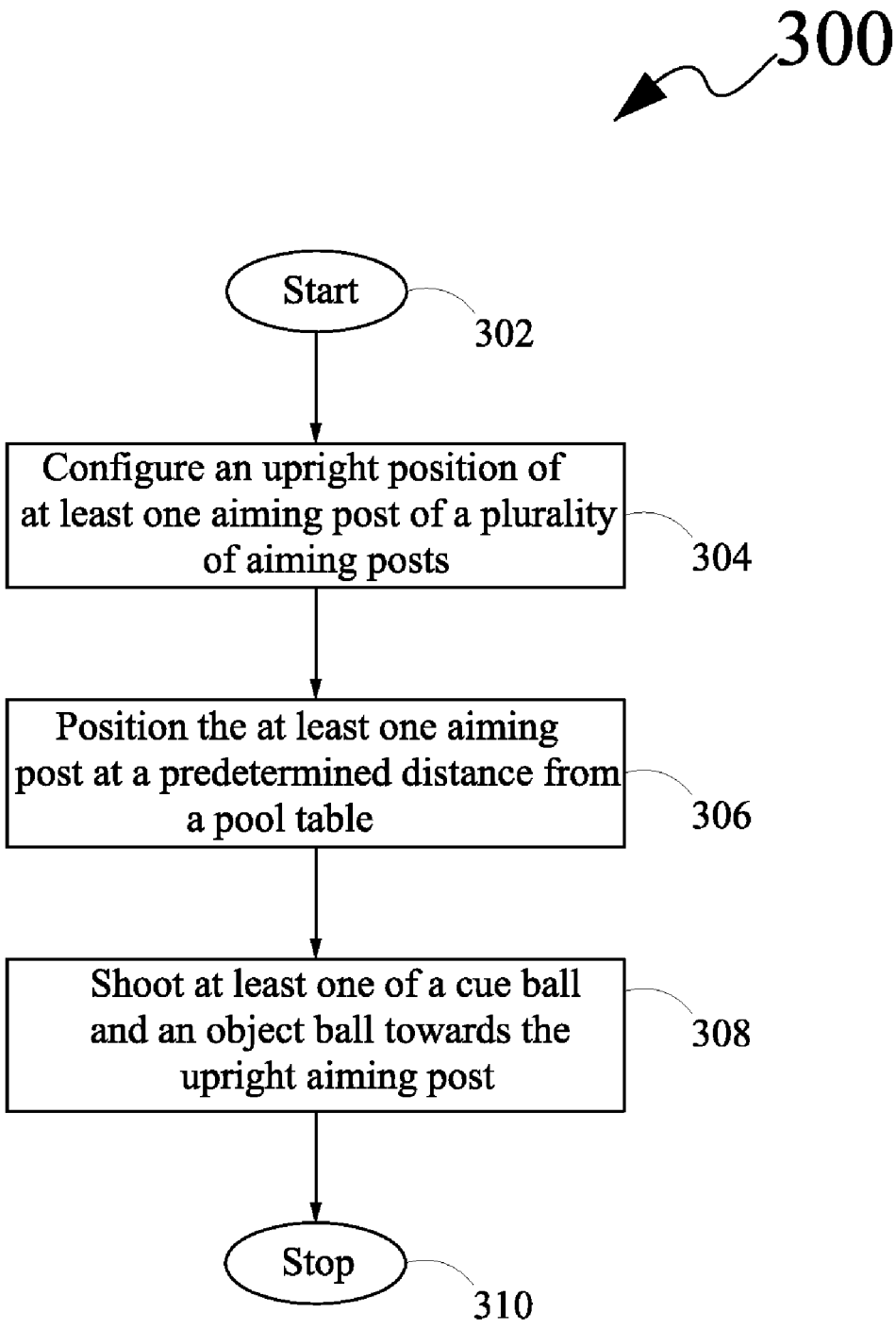
FIG. 4 illustrates a flow chart depicting a method for providing training for pool game bank shots, in accordance with an embodiment of the present disclosure.

Now referring to FIG. 4, a flow chart depicting a method 300 for providing training for bank shots is illustrated, in accordance with an exemplary embodiment of the present disclosure. The method 300 starts at 302. At 302, a size of the pool table may be determined. At 304, an upright position of at least one aiming post of a plurality of aiming posts is configured by receiving a proximal end portion of the at least one aiming post in a hollow central portion of a base member of a plurality of base members. At 306, the at least one aiming post configured in the upright position is positioned at a predetermined distance from the pool table. At 308, at least one of a cue ball and an object ball is shot towards the upright aiming post. The at least one aiming post configured in the upright position at the predetermined distance from the pool table provides an aiming point for aiming the at least one of the cue ball and the object ball for executing a pool game bank shot (hereinafter referred to as the bank shot). The method ends at 310. At 310, a player of the pool game may practice executing the bank shots by taking visual cue from the aiming post, and thereby train for the bank shots.

The upright position of the at least one aiming post of the plurality of aiming posts 102 may be configured as that configured for the aiming post 102*b* as explained in conjunction with FIG. 1. The aiming post configured in the upright position may be positioned at the pre-determined distance, such as at the Z position, as explained in conjunction with FIGS. 2A, 2B, 3A and 3B, for executing a bank shot such as the short axis bank shot and the long axis bank shot. Further, as explained in conjunction with FIGS. 2A, 2B, 3A and 3B, the pre-determined distance i.e. the location of the Z position may be determined based on the size of the pool table, pre-selected points on a short axis of the pool table, pre-selected points on a long axis of the pool table and an axial line passing through at least a pair of pocket centers of the pool table.

Further, in an embodiment of the present disclosure, the at least one aiming post of the plurality of aiming posts is about 31 inches in a length dimension. In another embodiment of the present disclosure, at least one aiming post of the plurality of aiming posts is about 5 inches in the length dimension. The at least one aiming post configured to be about 31 inches in the length dimension may enable the player of the pool game to configure the at least one aiming post in the upright position and dispose the at least one aiming post on a floor along side of the pool table as a floor target such that the at least one aiming post is visible while standing in natural shooting position. The at least one aiming post configured to be about 5 about inches in the length dimension may be positioned on the pool table as a table top target for aiming the at least one of the cue ball and the object ball for execution of the bank shot.

Various embodiments of the present disclosure offer following advantages. A kit, such as the kit 100, may be used by players of the pool game, and especially by amateur players of the pool game, for training for pool game bank shots. Practicing the pool game bank shot using an aiming post of the plurality of aiming posts configured in an upright position enables the players to train their eyes using visual cues and quickly identify aiming points for consistently executing the pool game bank shots. The players may then practice the bank shots without using the kit and yet reliably execute the bank shots. Moreover, as explained in method 400, the players may configure training assembly themselves and learn to effectively execute the bank shots without seeking professional help.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A kit for providing training for pool game bank shots on a pool table, the kit comprising:

a plurality of aiming posts, each aiming post of the plurality of aiming posts comprising a proximal end portion and a distal end portion; and a plurality of base members, each base member comprising a hollow central portion for receiving the proximal end portion of an aiming post of the plurality of aiming posts, wherein the proximal end portion of the aiming post received in the hollow central portion of a base member of the plurality of base members enables the aiming post to assume an upright position, and, wherein the aiming post of the plurality of aiming posts configured in the upright position and positioned at a pre-determined distance away from the pool table provides an aiming point for aiming at least one of a cue ball and an object ball for executing a pool game bank shot and, wherein said predetermined distance is determined based on the size of the pool table, pre-selected points on a short axis of the pool table, pre-selected points on a long axis of the pool table an axial line passing through at least a pair of pockets of the pool table, and wherein said predetermined distance is at a point away from and outside of the perimeter of the pool table and within the horizontal plane of a surface of the pool table.

2. The kit of claim 1 further comprising an instruction manual including instructions for executing the pool game bank shots.

3. The kit of claim 1, wherein the pre-determined distance from the pool table is determined based on size of the pool table, pre-selected points on a short axis of the pool table, pre-selected points on a long axis of the pool table and an axial line passing through at least a pair of pockets of the pool table.

4. The kit of claim 1, wherein at least one aiming post of the plurality of aiming posts is about 31 inches in a length dimension.

5. The kit of claim 1, wherein at least one aiming post of the plurality of aiming posts is about 5 inches in a length dimension.

6. A method for providing training for pool game bank shots using the kit of claim 1, the method comprising:

configuring the upright position of the at least one aiming post of the plurality of aiming posts by receiving the proximal end portion of the at least one aiming post in the hollow central portion of the base member of the plurality of base members;

positioning the at least one aiming post configured in the upright position at the predetermined distance from the pool table; and shooting the at least one of a cue ball and an object ball towards the upright aiming post, wherein the at least one aiming post configured in the upright position at the predetermined distance away from the pool table provides an aiming point for aiming the at least one of the cue ball and the object ball for executing a pool game bank shot, and wherein the pre-determined distance from the pool table is determined based on size of the pool table, pre-selected points on the short axis of the pool table, pre-selected points on the long axis of the pool table and the axial line passing through the at least pair of pockets of the pool table, and wherein said predetermined distance is at a point away from and outside of the perimeter of the pool table and within the horizontal plane of the surface of the pool table, such that a pool player may learn to train his or her eyes using visual cues and quickly identify aiming points for accurately and consistently executing pool game bank shots.

7. The method of claim 6, wherein the at least one aiming post of the plurality of aiming posts is about 31 inches in a length dimension.

8. The method of claim 6, wherein the at least one aiming post of the plurality of aiming posts is about 5 inches in a length dimension.

* * * * *